US009990896B2

(12) United States Patent
Cho

(10) Patent No.: US 9,990,896 B2
(45) Date of Patent: Jun. 5, 2018

(54) 6BIT/8BIT GAMMA COMMON DRIVING CIRCUIT AND METHOD FOR DRIVING THE SAME

(75) Inventor: Chang-Hun Cho, Gumi-si (KR)

(73) Assignee: LG DISPLAY CO., LTD, Seoul (KR)

( * ) Notice: Subject to any disclaimer, the term of this patent is extended or adjusted under 35 U.S.C. 154(b) by 1044 days.

(21) Appl. No.: 13/178,305

(22) Filed: Jul. 7, 2011

(65) Prior Publication Data

US 2012/0162274 A1 Jun. 28, 2012

(30) Foreign Application Priority Data

Dec. 22, 2010 (KR) ..... 10-2010-0132213

(51) Int. Cl.
*G09G 3/30* (2006.01)
*G09G 3/36* (2006.01)

(52) U.S. Cl.
CPC ..... *G09G 3/3688* (2013.01); *G09G 2310/027* (2013.01); *G09G 2320/0673* (2013.01)

(58) Field of Classification Search
USPC ..... 345/87–104, 211–213, 690–693
See application file for complete search history.

(56) References Cited

U.S. PATENT DOCUMENTS

2002/0145610 A1 10/2002 Barilovits et al.
2005/0140629 A1* 6/2005 Lee et al. ..... 345/89
(Continued)

FOREIGN PATENT DOCUMENTS

CN 1482587 A 3/2004
CN 1758319 A 4/2006
(Continued)

OTHER PUBLICATIONS

Office Action issued in corresponding German Patent Application No. 102011050272.6, dated Oct. 12, 2012.
(Continued)

*Primary Examiner* — Sanghyuk Park
(74) *Attorney, Agent, or Firm* — Seed Intellectual Property Law Group LLP

(57) ABSTRACT

The present invention relates to a 6 bit/8 bit gamma common driving circuit and a method for driving the same, in which a gamma voltage is changed selectively according to a number of received bits by using an R-string for using gamma in common. The 6 bit/8 bit gamma common driving circuit includes a gamma selection unit having an 8 bit receiving terminal for receiving a 6 bit or 8 bit digital data, and the gamma selection unit by passing the 8 bit data received at the receiving terminal, or adding "00" to least significant two bits of the 6 bit data received at the receiving terminal to change the 6 bit data to an 8 bit data and forwarding the 8 bit data, according to an external bit selection BSEL signal; a summing unit for summing most significant 6 bit data of the 8 bit data from the gamma selection unit and forwarding a carry signal "0 or 1", or summing the 8 bit data from the gamma selection unit and forwarding a carry signal "0 or 1", according to the bit selection BSEL signal; and a digital-to-analog converter for forwarding an analog signal corresponding to a R-string relevant to the data from the gamma selection unit if the carry signal from the summing unit is "0", or forwarding an analog signal corresponding to R225 of the R-string if the carry signal from the summing unit is "1".

5 Claims, 5 Drawing Sheets

(56) References Cited

U.S. PATENT DOCUMENTS

| | | | | |
|---|---|---|---|---|
| 2008/0122777 | A1* | 5/2008 | Kuo et al. | 345/98 |
| 2010/0289837 | A1* | 11/2010 | Hsu | 345/690 |

FOREIGN PATENT DOCUMENTS

| | | | |
|---|---|---|---|
| CN | 101248478 | A | 8/2008 |
| CN | 101317195 | A | 12/2008 |

OTHER PUBLICATIONS

Office Action issued in corresponding Chinese Patent Application No. 201110127002.3, dated Nov. 26, 2013, 10 pages.

* cited by examiner

6Bit D-IC

| 6Bit | | Gamma |
|---|---|---|
| DEC | BIN | |
| 0 | 000000 | 0.00% |
| 1 | 000001 | 6.35% |
| 2 | 000010 | 10.87% |
| 3 | 000011 | 14.46% |
| 4 | 000100 | 17.55% |
| - - | - - | |
| 56 | 111000 | 83.68% |
| 57 | 111001 | 73.19% |
| 58 | 111010 | 74.53% |
| 59 | 111011 | 76.05% |
| 60 | 111100 | 77.86% |
| 61 | 111101 | 80.19% |
| 62 | 111110 | 83.68% |
| 63 | 111111 | 100% |

<GMA Ratio>

<R-String>

8Bit D-IC

| 8Bit | | Gamma |
|---|---|---|
| DEC | BIN | |
| 0 | 00000000 | 0.00% |
| 1 | 00000001 | 1.83% |
| 2 | 00000010 | 3.48% |
| 3 | 00000011 | 4.98% |
| 4 | 00000100 | 6.35% |
| -- | -- | |
| 248 | 11111000 | 83.68% |
| 249 | 11111001 | 84.90% |
| 250 | 11111010 | 86.33% |
| 251 | 11111011 | 88.05% |
| 252 | 11111100 | 90.14% |
| 253 | 11111101 | 92.71% |
| 254 | 11111110 | 95.94% |
| 255 | 11111111 | 100% |

<GMA Ratio> <R-String>

<GMA Selection Block>

FIG. 5

| 6Bit | | 8Bit | | Gamma |
|---|---|---|---|---|
| DEC | BIN | DEC | BIN | |
| 0 | 000000 | 0 | 00000000 | 0.00% |
| | | 1 | 00000001 | |
| | | 2 | 00000010 | |
| | | 3 | 00000011 | |
| 1 | 000001 | 4 | 00000100 | 6.35% |
| -- | -- | -- | -- | |
| 62 | 111110 | 248 | 11111000 | 83.68% |
| | | 249 | 11111001 | |
| | | 250 | 11111010 | |
| | | 251 | 11111011 | |
| 63 | 111111 | 252 | 11111100 | 97.10% |
| | | 253 | 11111100 | |
| | | 254 | 11111110 | |
| 63 | 111111 | 255 | 11111111 | 100% |

| C | | D7 | + | D6 | + | D5 | + | D4 | + | D3 | + | D2 |
|---|---|---|---|---|---|---|---|---|---|---|---|---|
| 0 | | 0 | | 1 | | 1 | | 1 | | 0 | | 0 |
| 1 | | 1 | | 1 | | 1 | | 1 | | 1 | | 1 |

Sum 6bit data and select R255 if carry is 1

There is about 3% of difference at total R-string in comparison to normal.

6BIT/8BIT GAMMA COMMON DRIVING CIRCUIT AND METHOD FOR DRIVING THE SAME

Pursuant to 35 U.S.C. § 119(a), this application claims the benefit of earlier filing date and right of priority to Korean Application 10-2010-0132213, filed on Sep. 22, 2010, the content of which is incorporated by reference herein in its entirety.

BACKGROUND

Field of the Invention

The present disclosure relates to liquid crystal display devices, and more particularly, to a 6 bit/8 bit gamma common driving circuit and a method for driving the same, in which a gamma voltage is changed selectively according to a number of received bits by using an R-string for using gamma in common.

Discussion of the Related Art

Recent flat panel displays include liquid crystal display devices, field emission display devices, plasma display panels, and light emitting display devices. Of the flat panel displays, since the liquid crystal display device has excellent resolution, color expression and picture quality, the liquid crystal display device has been applied to note book computers, desk top monitors, and mobile terminals, actively.

The liquid crystal display device includes a liquid crystal panel having a plurality of gate lines and data lines and a matrix of pixels, a gate driver for driving the gate lines at the liquid crystal panel, and a data driver for driving the data lines at the liquid crystal panel.

Each of the pixels in the liquid crystal panel produces a desired color by a combination of red, green, and blue sub-pixels each of which varies an orientation of liquid crystals to control transmissivity of the light in response to a data signal. Each of the sub-pixels has a thin film transistor connected to the gate line and the data line, and a liquid crystal capacitor connected to the thin film transistor. The liquid crystal capacitor has a pixel voltage which is a difference of voltages between the data signal supplied to a pixel electrode and a common voltage supplied to the common electrode charged thereto and drives the liquid crystals according to the pixel voltage charged thus to control the transmissivity of the light.

The data driver converts a digital data signal to an analog data signal, and supplies the analog data signal to the data line at the liquid crystal panel. For this, the data driver has a digital-to-analog converter for converting the digital data signal to the analog data signal. The digital-to-analog converter has an R-string having a plurality of resistors connected in series, and a selection switch circuit for selective forwarding of voltages divided by the R-string according to a digital signal.

However, a related art data driver IC which supplies the data voltages to the data lines uses the R-string different varied with a number of received bits, to sort products thereof in view of the number of the bits receivable thus.

FIG. 1 illustrates a diagram for describing a gamma voltage ratio and an R-string versus received bits at a related art 6 bit data driver IC, and FIG. 2 illustrates a diagram for describing a gamma voltage ratio and an R-string versus received bits at a related art 8 bit data driver IC.

In general, a gradient denotes a quantity of a light a human visual sensation feels divided by grades. According to the Weber's law, the human visual sensation makes non-linear reaction to brightness of the light. Because of this, if the brightness of the light is recorded linearly within a limited information expression quantity, such as k bit/a channel, the brightness of the light recorded thus is felt, not smoothly, but graded, to human eyes. Therefore, in order to show an optimum picture quality within a given information expression quantity, it is required to encode the brightness of the light, non-linearly. For this, an operation is performed for matching a difference between a driving characteristic of the display panel and the human visual sensation characteristic, which is called as gamma correction. In general, in the gamma correction, a plurality of gamma reference voltage values are set, which are fixed according to the display panel characteristic, and the gamma reference voltage values set thus are divided for compensating a gamma value of each of received digital video data.

Referring to FIG. 1, the related art 6 bit data driver IC drives a digital data received in 64 gradients as an analog signal. As shown in FIG. 2, the related art 8 bit data driver IC drives a digital data received in 256 gradients as an analog signal.

That is, the related art data driver IC which supplies a data voltage to each of the data lines uses R-strings varied with the numbers of received bits, to make the products varied with the numbers of received bits.

Consequently, since the number of bits the drive IC can use is fixed, common use of the chip has been impossible due to the variation of the number of bits.

BRIEF SUMMARY

A 6 bit/8 bit gamma common driving circuit includes a gamma selection unit having an 8 bit receiving terminal for receiving a 6 bit or 8 bit digital data, and the gamma selection unit by passing the 8 bit data received at the receiving terminal, or adding "00" to least significant two bits of the 6 bit data received at the receiving terminal to change the 6 bit data to an 8 bit data, and forwarding the 8 bit data, according to an external bit selection BSEL signal, a summing unit for summing most significant 6 bit data of the 8 bit data from the gamma selection unit and forwarding a carry signal "0" or "1", or summing the 8 bit data from the gamma selection unit and forwarding a carry signal "0" or "1", according to the bit selection BSEL signal, and a digital-to-analog converter for forwarding an analog signal corresponding to a R-string relevant to the data from the gamma selection unit if the carry signal from the summing unit is "0", or forwarding an analog signal corresponding to R255 of the R-string if the carry signal from the summing unit is "1".

In another aspect of the present invention, a method for common driving of a 6 bit/8 bit gamma includes the steps of setting a bit selection BSEL signal varying with whether it is an 8 bit image signal processing mode or a 68 bit image signal processing mode; selecting an R-string relevant to a received image data and forwarding an analog signal corresponding to the selected R-string if the bit selection BSEL signal is set to be the 8 bit image signal processing mode; and adding "00" to least significant 2 bits of a received 6 bit image data to change the 6 bit image data to an 8 bit image data, selecting an R-string relevant to the 8 bit image data changed thus, and forwarding an analog signal corresponding to the selected R-string if the bit selection BSEL signal is set to be the 6 bit image signal processing mode.

The method further includes the step of forwarding an analog signal corresponding to R255 of the R-string if the received 6 bit image data is "111111".

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings:

FIG. 5 illustrates a diagram for describing a method for processing a 6 bit data by using an 8 bit data driver.

DETAILED DESCRIPTION OF THE DRAWINGS AND THE PRESENTLY PREFERRED EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
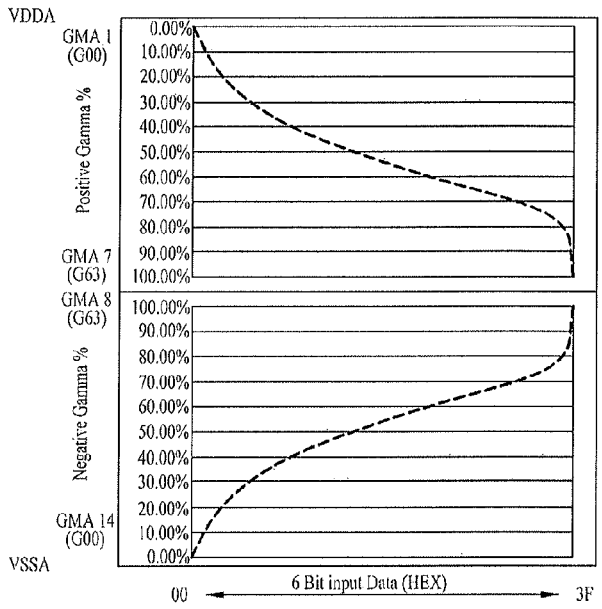
FIG. 1 Related art
FIG. 1 illustrates a diagram for describing a gamma voltage ratio and an R-string versus received bits at a related art 6 bit data driver IC.
Figure 2:
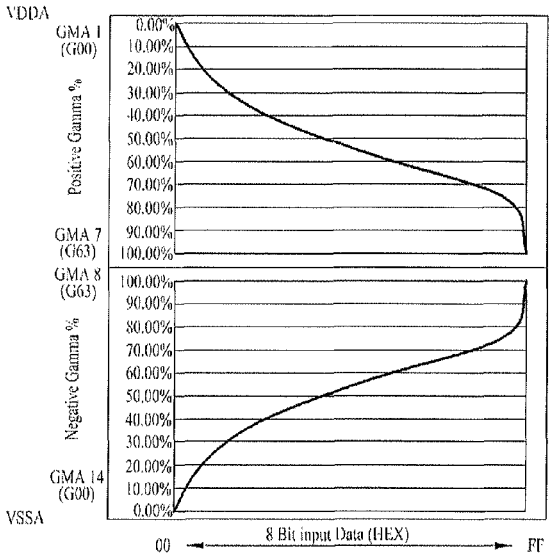
FIG. 2 Related art
FIG. 2 illustrates a diagram for describing a gamma voltage ratio and an R-string versus received bits at a related art 8 bit data driver IC.
Figure 3:
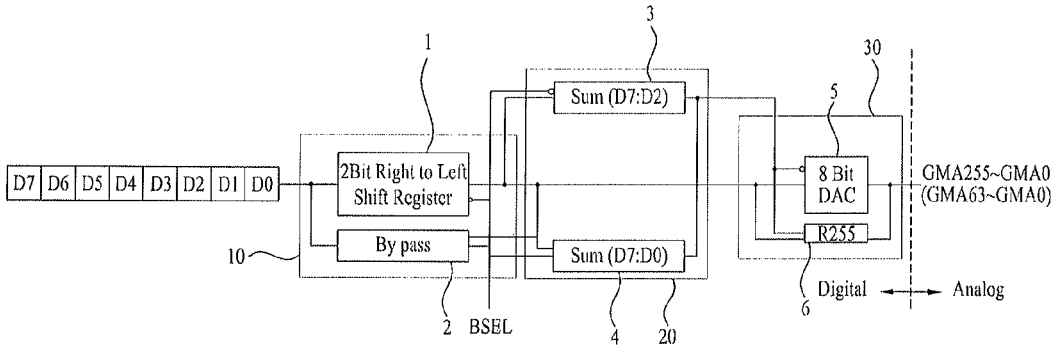
FIG. 3 illustrates a block diagram of a 6 bit/8 bit gamma common driving circuit in accordance with a preferred embodiment of the present invention.

FIG. 3 illustrates a block diagram of a 6 bit/8 bit gamma common driving circuit in accordance with a preferred embodiment of the present invention.

Referring to FIG. 3, the 6 bit/8 bit gamma common driving circuit in accordance with a preferred embodiment of the present invention includes a gamma selection unit 10 having an 8 bit receiving terminal for receiving a digital data, and by passing an 8 bit data received at the 8 bit receiving terminal according to an external bit selection BSEL signal if the bit selection BSEL signal indicates an 8 bit digital data, or adding "00" to least significant two bits of a received 6 bit data to change the 6 bit data to an 8 bit data if the bit selection BSEL signal indicates a 6 bit digital data, a summing unit 20 for summing most significant 6 bit data of the 8 bit data received from the gamma selection unit 10 if the bit selection BSEL signal indicates the 6 bit digital data, and forwarding a carry signal "0" or "1", or summing the 8 bit data received from the gamma selection unit 10 if the bit selection BSEL signal indicates the 8 bit digital data, and forwarding a carry signal "0" or "1", and a digital-to-analog converter 30 for forwarding an analog signal corresponding to the data from the gamma selection unit 10 to a relevant R-string without a particular operation if the carry signal from the summing unit 20 is "0", or forwarding an analog signal corresponding to R255 of the R-string if the carry signal from the summing unit 20 is "1".

In this instance, the gamma selection unit 10 includes a shift register 1 for adding "00" to the least significant 2 bits of the received 6 bit data and forwarding the same if the bit selection BSEL signal indicates 6 bit digital data, and a by-pass unit 2 for by passing the received 8 bit data received at the receiving terminal if the bit selection BSEL signal indicates the 8 bit digital data.

The summing unit 20 includes a first summing unit 3 for summing most significant 6 bit data of the 8 bit data received from the gamma selection unit 10 and forwarding a carry signal "0 or 1" if the bit selection BSEL signal indicates the 6 bit digital data, and a second summing unit 4 for summing the 8 bit data received from the gamma selection unit 10 and forwarding a carry signal "0 or 1" if the bit selection BSEL signal indicates the 8 bit digital data.

The digital-to-analog converter 30 includes an 8 bit digital-to-analog converter 5 for forwarding an analog signal corresponding to the data from the gamma selection unit 10 by selecting a relevant R-string without a particular operation if the carry signal from the summing unit 20 is "0", and a R255 forwarding unit 6 for forwarding an analog signal corresponding to R255 of the R-string if the carry signal from the summing unit 20 is "1".

A method for driving the 6 bit/8 bit gamma common driving circuit in accordance with a preferred embodiment of the present invention will be described.

Figure 4:
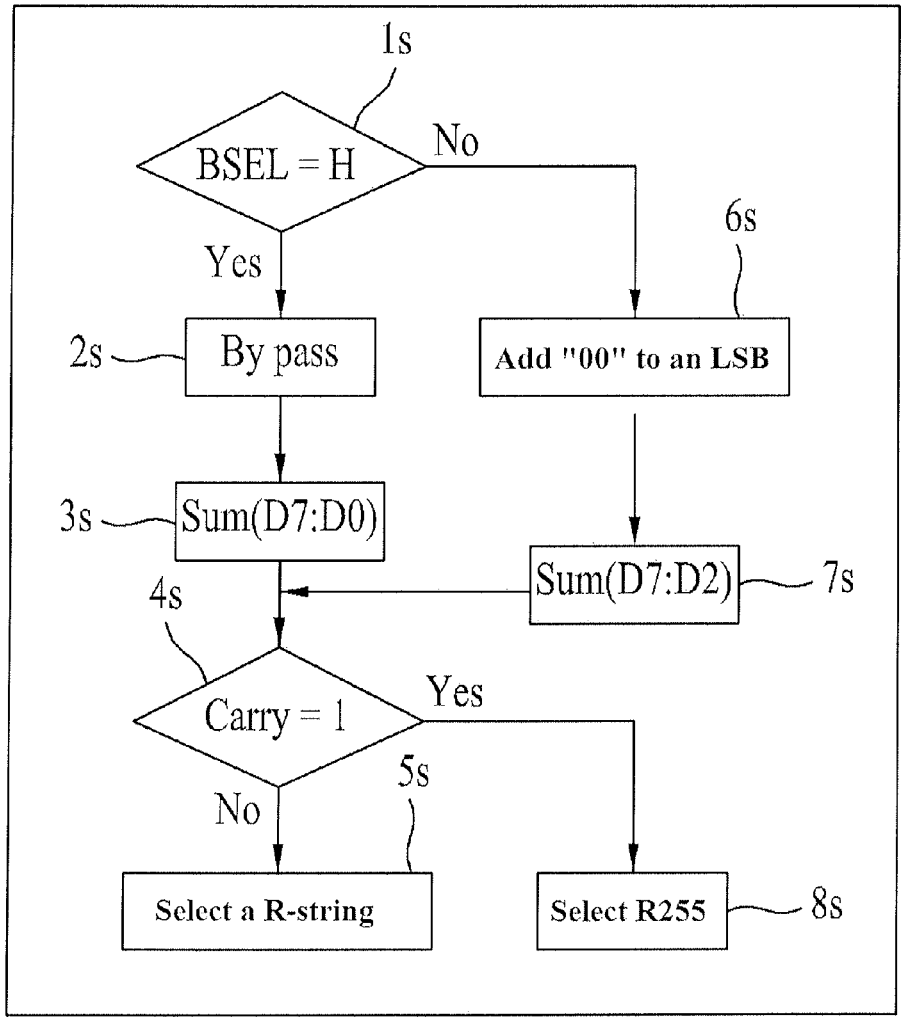
FIG. 4 illustrates a flow chart showing the steps of operation of a 6 bit/8 bit gamma common driving circuit in accordance with a preferred embodiment of the present invention.

FIG. 4 illustrates a flow chart showing the steps of operation of a 6 bit/8 bit gamma common driving circuit in accordance with a preferred embodiment of the present invention, and FIG. 5 illustrates a diagram for describing a method for processing a 6 bit data by using an 8 bit data driver.

At first, in a case of an 8 bit image signal processing mode, a bit selection BSEL signal is set to be "high", and in a case of a 6 bit image signal processing mode, the bit selection BSEL signal is set to be "low". And, an image data input signal line is connected such that the 6 bit image data is applied to the most significant 6 bit input terminals of the 8 bit input terminals at the gamma selection unit 10 in FIG. 3.

In this state, it is determined whether the bit selection BSEL signal indicates the 8 bit image signal processing mode or the 6 bit image signal processing mode, according to the bit selection BSEL signal.

If the bit selection BSEL signal is set to be "high" (1S), the shift register 1 in the gamma selection unit 10 is disabled not to operative, but the by pass unit 2 is put into operation for by passing the received 8 bit data (2S).

And, the second summing unit 4 in the summing unit 20 comes into operation for forwarding a carry signal of "0" (4S) and forwarding an analog data corresponding to an R-string relevant to the received data (5S) in response to a signal excluding a case the 8 bit received data is "11111111".

In a case the 8 bit received data is "11111111", the second summing unit 4 forwards the carry signal "1" (4S), such that the R255 forwarding unit 6 forwards an analog signal corresponding to R255(8S). That is, in a case of the 8 bit image signal processing mode, alike the related art, the R255 forwarding unit 6 converts the digital image data by passed and received thus into an analog signal and forwards the same.

In the meantime, if the bit selection BSEL signal is set to be "low" (1S), the by-pass unit 2 in the gamma selection unit 10 is disabled not to operative, but the shift register 1 is enabled to shift the received 6 bit image data in a left direction by 2 bits to add "00" to the least significant 2 bits and forwards the same (6S).

Referring to FIG. 5, the first summing unit 3 in the summing unit 20 comes into operation for forwarding a carry signal of "0" if the most significant 6 bit of the 8 bit received data from the shift register 1 are data excluding a case the most significant 6 bits are "111111" (7S), such that the 8 bit digital-to-analog converter forwards an analog signal corresponding to an R-string relevant to the received data (5S).

Referring to FIG. 5, in a case the most significant 6 bit data are "111111", the first summing unit 3 forwards the carry signal "1", such that the R255 forwarding unit 6 forwards an analog signal corresponding to R255.

In this instance, if the most significant 6 bit data is "111111", the R255 forwarding unit 6 does not forwards the analog signal corresponding to R255, but can select an R-string relevant to a data of "11111100" directly and forwards the analog signal.

However, in this case, the following distortion can take place.

If "00" is added to the least significant 2 bits by shifting the 6 bit data 111111 to a left side by 2 bits, the 6 bit data 111111 becomes an 8 bit data "11111100". Therefore, if a relevant R-string is selected with the data, which falls under a R252 gradient of 8 bit data to have a 97% gamma ratio at the R-string, around 3% of gamma distortion takes place.

Therefore, in order to prevent the distortion from taking place, if the most significant 6 bit data is "111111", R255 is selected to make the gamma ratio to be 100%.

As have been described, the 6 bit/8 bit gamma common driving circuit and the method for driving the same have the following advantages.

That is, since a number of bits the drive IC can use is fixed, required to use different R-strings according to a number of received bits in the related art, since the present invention enables to change a gamma voltage of 6 bit or 8 bit received data selectively by using the 8 bit R-string, the present invention embody the 6 bit/8 bit gamma common driving circuit.

Accordingly, not only components can be used in common, but also common use of the liquid crystal panel can be expected. Especially, common use of a COG panel can be expected.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A 6 bit/8 bit gamma common driving circuit comprising:

a gamma selection unit having an 8 bit receiving terminal that receives a 6 bit or 8 bit digital data, and the gamma selection unit by passing the 8 bit data received at the receiving terminal, or adding "00" to least significant two bits of the 6 bit data received at the receiving terminal to change the 6 bit data to an 8 bit data and forward the 8 bit data, according to an external bit selection BSEL signal having a high level and a low level and indicating the 6 bit or 8 bit digital data based on the high level or the low level of the bit selection BSEL signal;

a summing unit that sums either most significant 6 bit data of the 8 bit data from the gamma selection unit and forwards a carry signal "0" or "1", or sums the 8 bit data from the gamma selection unit and forwards a carry signal "0" or "1", according to the bit selection BSEL signal; and a digital-to-analog converter that forwards an analog signal corresponding to a R-string relevant to the data from the gamma selection unit if the carry signal from the summing unit is "0", or forwards an analog signal corresponding to R255 of the R-string if the carry signal from the summing unit is "1".

2. The circuit as claimed in claim 1, wherein the gamma selection unit includes:

a shift register that adds "00" to the least significant 2 bits of the received 6 bit data and forwards the same if the bit selection BSEL signal indicates 6 bit digital data; and a bypass unit that by passes the received 8 bit data received at the receiving terminal if the bit selection BSEL signal indicates the 8 bit digital data.

3. The circuit as claimed in claim 1, wherein the summing unit includes:

a first summing unit that sums most significant 6 bit data of the 8 bit data received from the gamma selection unit and forwards a carry signal "0" or "1" if the bit selection BSEL signal indicates the 6 bit digital data, and a second summing unit that sums the 8 bit data received from the gamma selection unit and forwards a carry signal "0" or "1" if the bit selection BSEL signal indicates the 8 bit digital data.

4. The circuit as claimed in claim 1, wherein the digital-to-analog converter includes:

an 8 bit digital-to-analog converter that forwards an analog signal corresponding to the R-string relevant to the data from the gamma selection unit if the carry signal from the summing unit is "0"; and a R255 forwarding unit that forwards an analog signal corresponding to R255 of the R-string if the carry signal from the summing unit is "1".

5. A method for common driving of a 6 bit/8 bit gamma comprising the steps of:

setting a bit selection BSEL signal varying with whether it is an 8 bit image signal processing mode or a 6 bit image signal processing mode, wherein the bit selection BSEL signal has a high level and a low level and indicates the 6 bit image signal processing mode or the 8 bit image signal processing mode based on the high level or the low level of the bit selection BSEL signal;

selecting an R-string relevant to a received image data and forwarding an analog signal corresponding to the selected R-string if the bit selection BSEL signal is set to be the 8 bit image signal processing mode;

adding "00" to least significant 2 bits of a received 6 bit image data to change the 6 bit image data to an 8 bit image data, selecting an R-string relevant to the 8 bit image data changed thus, and forwarding an analog signal corresponding to the selected R-string, if the bit selection BSEL signal is set to be the 6 bit image signal processing mode; and forwarding an analog signal corresponding to R255 of the R-string if the received 6 bit image data is "111111".

* * * * *